US005743191A

United States Patent [19]

Coslovi

[11] Patent Number: 5,743,191

[45] Date of Patent: Apr. 28, 1998

[54] PLATFORM STEP AND FOOTHOLD ARRANGEMENT FOR RAILCAR END STRUCTURE

[75] Inventor: Ilario A. Coslovi, Burlington, Canada

[73] Assignee: National Steel Car Ltd., Canada

[21] Appl. No.: 642,226

[22] Filed: Apr. 30, 1996

[51] Int. Cl.[6] ..... B61D 3/00

[52] U.S. Cl. ..... 105/355; 105/404; 105/436; 105/443

[58] Field of Search ..... 105/355, 404, 105/410, 413, 414, 416, 420, 421, 425, 436, 443

[56] References Cited

U.S. PATENT DOCUMENTS

| | | | |
|---|---|---|---|
| 4,718,353 | 1/1988 | Schuller et al. | 105/406.1 |
| 4,756,256 | 7/1988 | Rains et al. | 105/355 |
| 4,807,722 | 2/1989 | Jamrozy et al. | 105/355 |
| 5,379,702 | 1/1995 | Saxton et al. | 105/355 |
| 5,423,269 | 6/1995 | Saxton et al. | 105/404 |
| 5,465,670 | 11/1995 | Butcher | 105/404 |

*Primary Examiner*—Mark T. Le
*Attorney, Agent, or Firm*—Oldham & Oldham Co., LPA

[57] ABSTRACT

A platform arrangement for an end structure of a railway well car having a well portion defined by spaced apart side structures, opposing end structures and a floor structure extending between the side structures. Each of the end structures has spaced apart sidewalls, with a horizontally disposed shear plate extending between and connecting to the sidewalls. Each of the end structures further includes (i) an upper bolster extending upwardly from the shear plate and connecting to the sidewalls; (ii) a bulkhead depending from an inboard end of the shear plate, which extends into the well portion and between the sidewalls to connect to them; and (iii) a stub centre sill positioned below the shear plate. The platform arrangement itself comprises (i) a first horizontal platform surface; (ii) a second horizontal platform surface; (iii) an outboard intermediate horizontal platform surface; (iv) an inboard intermediate horizontal platform surface: and (v) a foothold provided with the bulkhead. The first and second horizontal platforms surface extend transversely of the well car. The first is disposed at a position outboard of the upper bolster; the second is disposed immediately above the upper bolster. The outboard intermediate platform is disposed above the first platform and below the second platform at a position outboard of the upper bolster. The inboard intermediate platform is disposed below the second platform and above the shear plate at a position inboard of the upper bolster member. The foothold is located at a vertical position intermediate of the shear plate and the floor structure. The platform arrangement constitutes means for accessing the well portion of the well car from ground level by successively stepping onto the first platform, the outboard intermediate platform, the second platform, the inboard intermediate platform, the shear plate and the foothold.

14 Claims, 6 Drawing Sheets

PLATFORM STEP AND FOOTHOLD ARRANGEMENT FOR RAILCAR END STRUCTURE

FIELD OF INVENTION

This invention pertains to a railroad freight car for carrying intermodal cargo containers. In particular, this invention relates to a platform, step and foothold arrangement for a railcar end structure.

BACKGROUND OF THE INVENTION

The prior art has provided a variety of freight cars adapted to carry intermodal cargo containers. One type of container car in use is referred to as a well car since it has a container receiving well portion between car railway trucks at each end of the car.

The earlier well cars had wells forty feet in length, which were designed to carry one 40-foot or two 20-foot containers in the lower tier. However, in more recent times, longer intermodal cargo containers have become available. Now, such containers come in standard lengths of not only 20 feet and 40 feet, but also 45 feet, 48 feet and 53 feet. As the standard lengths of containers have increased, the length of the well in a well car has also increased so as to accommodate such containers.

Regardless of the length of the container(s) in the lower tier, in order to distribute the load evenly in the well of the car, the container(s) must be longitudinally centered in the well. Thus, when a 40-foot container is placed in a 48 foot well, there is a four foot gap between the longitudinal end of the well and the longitudinal end of the container.

When the railway car is loaded and in transport, forces act upon the containers in the double-stacked container load to cause the containers to translate, pitch and rotate. In order to prevent the displacement of the containers by these forces, container interbox connectors are used to secure containers in the upper tier to containers in the lower tier by connecting the containers together at the corner castings thereof. As is well known to those in this art, a corner casting is fixedly attached to each corner of an intermodal container. The casting has three sides facing externally of the container, and that are each generally flush with the respective sidewalls of the container. Each side of the casting provides an aperture therein for anchoring, locating or securing the intermodal container during handling and transport. The interbox connectors typically connect each corner casting of a container in the lower tier to an immediately adjacent corner casting of the container in the upper tier.

Since intermodal cargo containers are typically 8.5 feet or 9.5 feet in height and railroad standards require a specified minimum clearance to be maintained beneath the railcar, a typical operator of average height cannot reach the corner castings to attach the container connectors from the ground. In addition, a typical operator of average height often cannot safely reach the castings from the end structure of the car due to the gap between the well end and the container end. There exists a need for an improved well car having means which permits an operator to conveniently and safely access the ends of double-stacked containers of various standard lengths in a well car.

In addition, as an operator is often required to descend into the well of the freight car to perform maintenance on the car body and structure or to access the inboard areas of the railway truck supporting the end structure, there is a need for an improved well car having means which permits an operator to conveniently and safely descend into the well of the car.

SUMMARY OF THE INVENTION

According to a broad aspect of the present invention, there is provided a platform arrangement for an end structure of a railway well car. The railway well car is of the type having spaced apart side structures, opposing end structures and a floor structure extending between the side structures. The side structures, end structures and floor structure together define a well portion for receiving a cargo container. Each of the end structures has spaced apart sidewalls, with a substantially planar and horizontally disposed shear plate which has an inboard end. The shear plate extends between the sidewalls and is connected to them. Each of the end structures further includes (i) a transverse structural member extending upwardly from the shear plate and to the sidewalls; (ii) a bulkhead depending from the inboard end of the shear plate, which extends into the well portion and between the sidewalls to connect to them; and (iii) a stub centre sill for housing a coupler means for connecting the well car to another railway car. The stub centre sill is positioned below the shear plate and extends longitudinally of the well car from an inboard position adjacent the bulkhead to an outboard position external of the well car. The platform arrangement itself comprises (i) a first horizontal platform surface; (ii) a second horizontal platform surface; (iii) an outboard intermediate horizontal platform surface; (iv) an inboard intermediate horizontal platform surface; and (v) a foothold provided with the bulkhead. The first horizontal platform surface extends transversely of the well car and disposed at a position outboard of the transverse structural member. The second horizontal platform surface extends transversely of the well car and is disposed immediately above the transverse structural member. The outboard intermediate horizontal platform is disposed above the first horizontal platform surface and below the second horizontal platform surface at a position outboard of the transverse structural member. The inboard intermediate horizontal platform surface is disposed below the second horizontal platform surface and above the shear plate at a position inboard of the transverse structural member. The foothold is located at a vertical position intermediate of the shear plate and the floor structure. The platform arrangement constitutes means for accessing the well portion of the well car from ground level by successively stepping onto the first horizontal platform surface, the outboard intermediate horizontal platform surface, the second horizontal platform surface, the inboard intermediate platform surface, the shear plate and the foothold.

With reference to the preferred embodiments of the present invention, the outboard intermediate horizontal platform surface is one of two platform surfaces disposed in a co-planar relationship with each other and arranged in a flanking relationship relative to the stub centre sill.

The inboard intermediate horizontal platform surface is one of two steps provided between the second horizontal platform surface and the shear plate.

The transverse structural member is an upper bolster upon which the second horizontal platform surface is mounted.

The second horizontal platform surface extends transversely of the well car for substantially the full width thereof. The first horizontal platform surface is disposed above the stub centre sill and is supported by a plurality of spaced apart and longitudinally extending support arms disposed in a flanking relationship relative to the stub centre sill. The first horizontal platform surface extends transversely of the well car for substantially the full width thereof. The support arms are attached at their inboard ends to the sidewalls of the end structure.

In the preferred embodiment, the platform arrangement further comprises a pair of longitudinally extending side platform surfaces. Each of the such side platform surfaces is located immediately above the side structure of the end structure and is co-planar with the second horizontal platform surface. Each side platform surface extends along an uppermost edge of the side structure and has an inward longitudinal edge positioned outward from a perimeter of the well so as not to obstruct loading and unloading of a cargo container into and out of the well.

Furthermore, in the preferred embodiment, a sill step is provided adjacent the first horizontal platform surface, to provide a foot step located at a vertical position intermediate to that of the first horizontal platform surface and ground level. Further, the foothold in the bulkhead is one of a plurality of footholds provided with the bulkhead.

BRIEF DESCRIPTION OF THE DRAWINGS

For purposes of illustration, but not of limitation, preferred embodiments of the present invention will next be described with reference to the following drawings, in which.

DETAILED DESCRIPTION OF THE DRAWINGS

Figure 1:
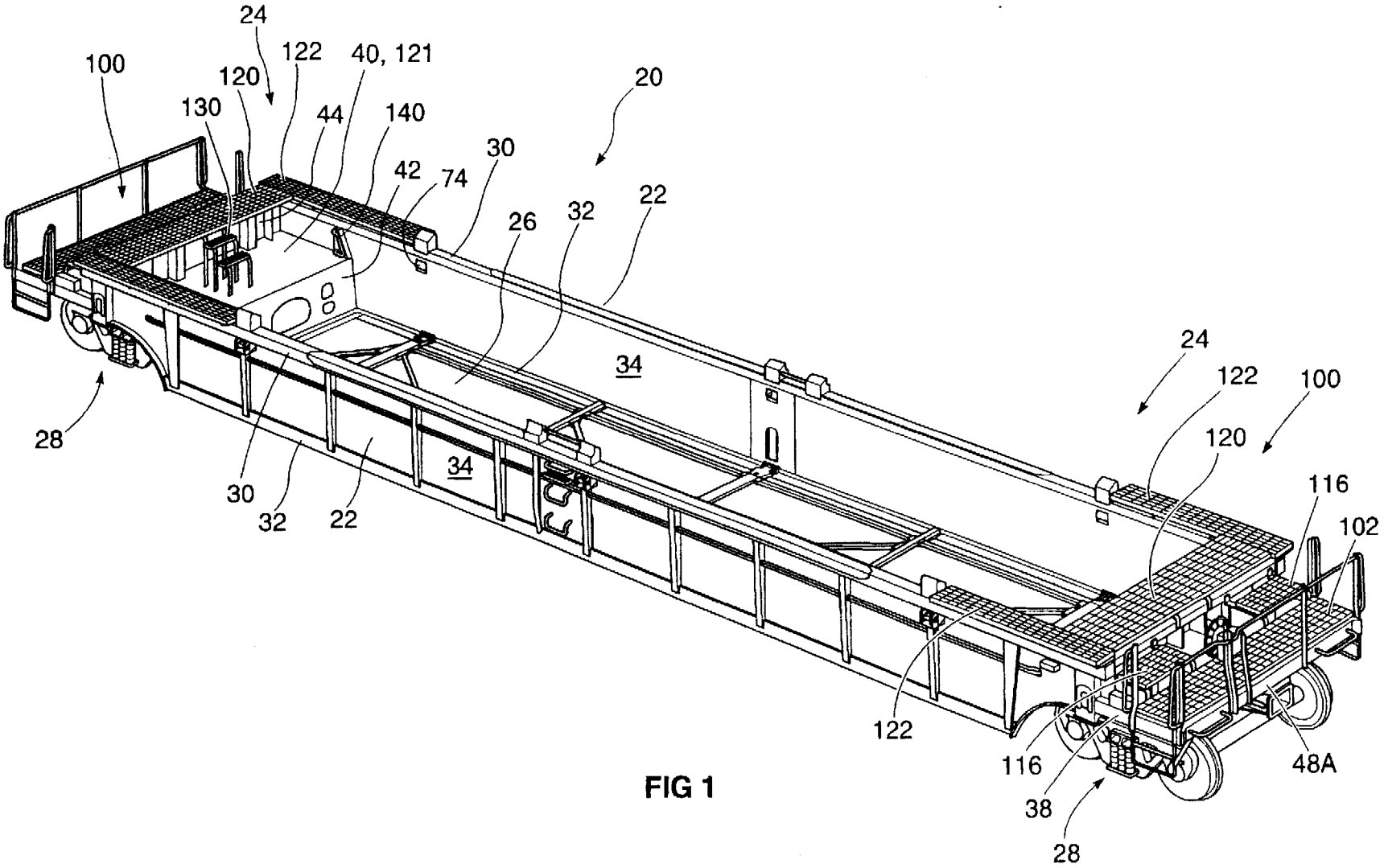
FIG. 1 is a perspective view of a railroad freight car having a platform arrangement of the present invention.

A railway well car for transporting horizontal double-stacked intermodal cargo containers having a platform arrangement of the present invention at its end structure is shown in FIG. 1 as 20. The car has a longitudinally extending load bearing frame structure formed by spaced apart side structures 22, opposing end structures 24 and a floor structure 26. The frame structure is mounted at its ends on conventional railway trucks 28 which run on railway tracks. The side structures 22, end structures 24 and the floor structure 26 define a well portion for receiving one or more intermodal cargo containers. Each side structure 22 comprises a top side chord 30, a bottom side chord 32 and a sidewall 34.

One end structure 2.4 is more particularly illustrated in FIGS. 3 to 6. The end structure 24 comprises a stub centre sill 36, support arms 38, a shear plate 40, an inboard bulkhead 42 and a transverse structural member, for example an upper bolster 44.

Figure 3:
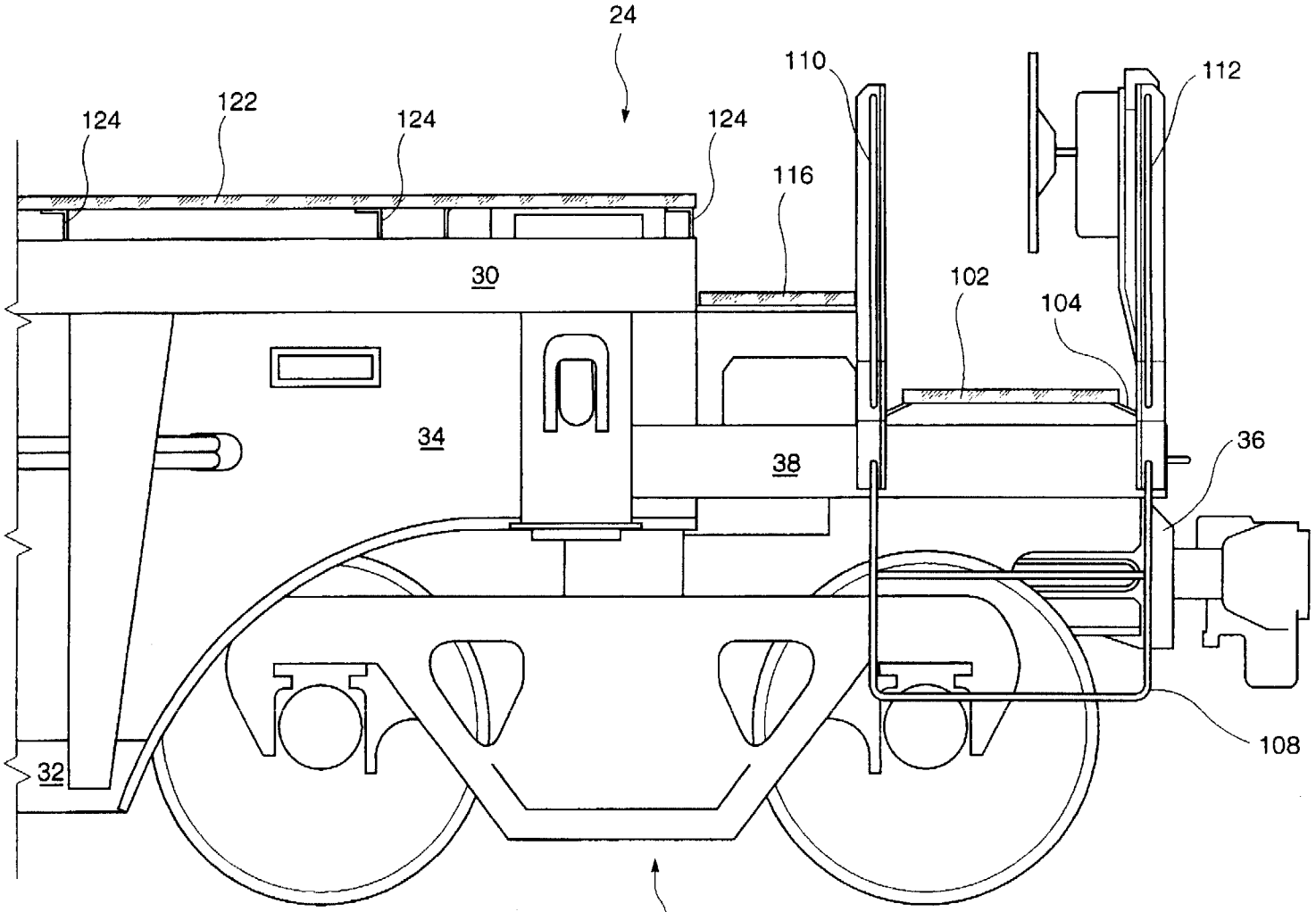
FIG. 3 is a detailed side elevational view of one end of the railroad car depicted in FIG. 1.
Figure 4:
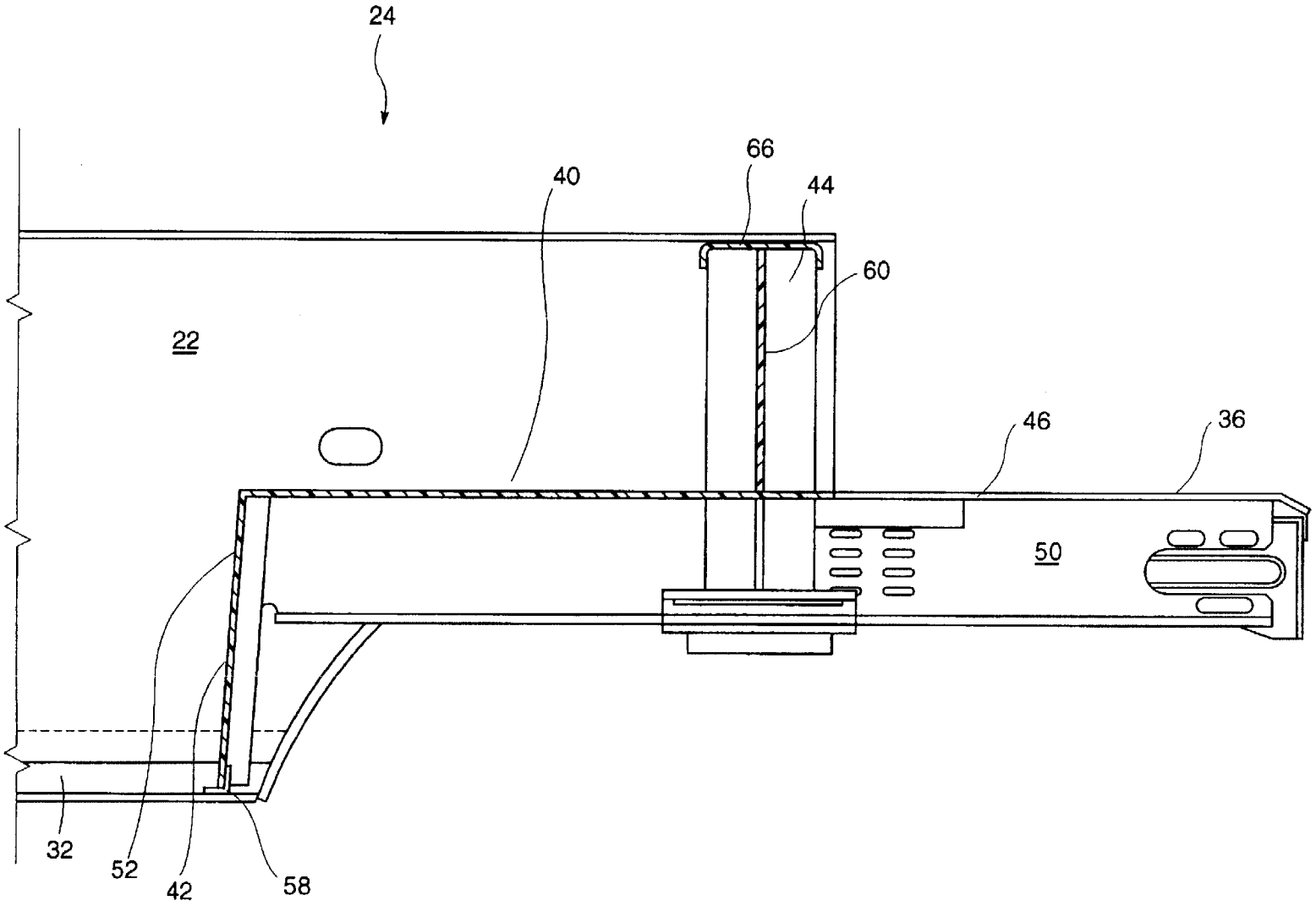
FIG. 4 is a sectional view of the end of the railroad car depicted in FIG. 1, shown without the platform arrangement or truck, taken along view line 4—4 in FIG. 2.
Figure 5:
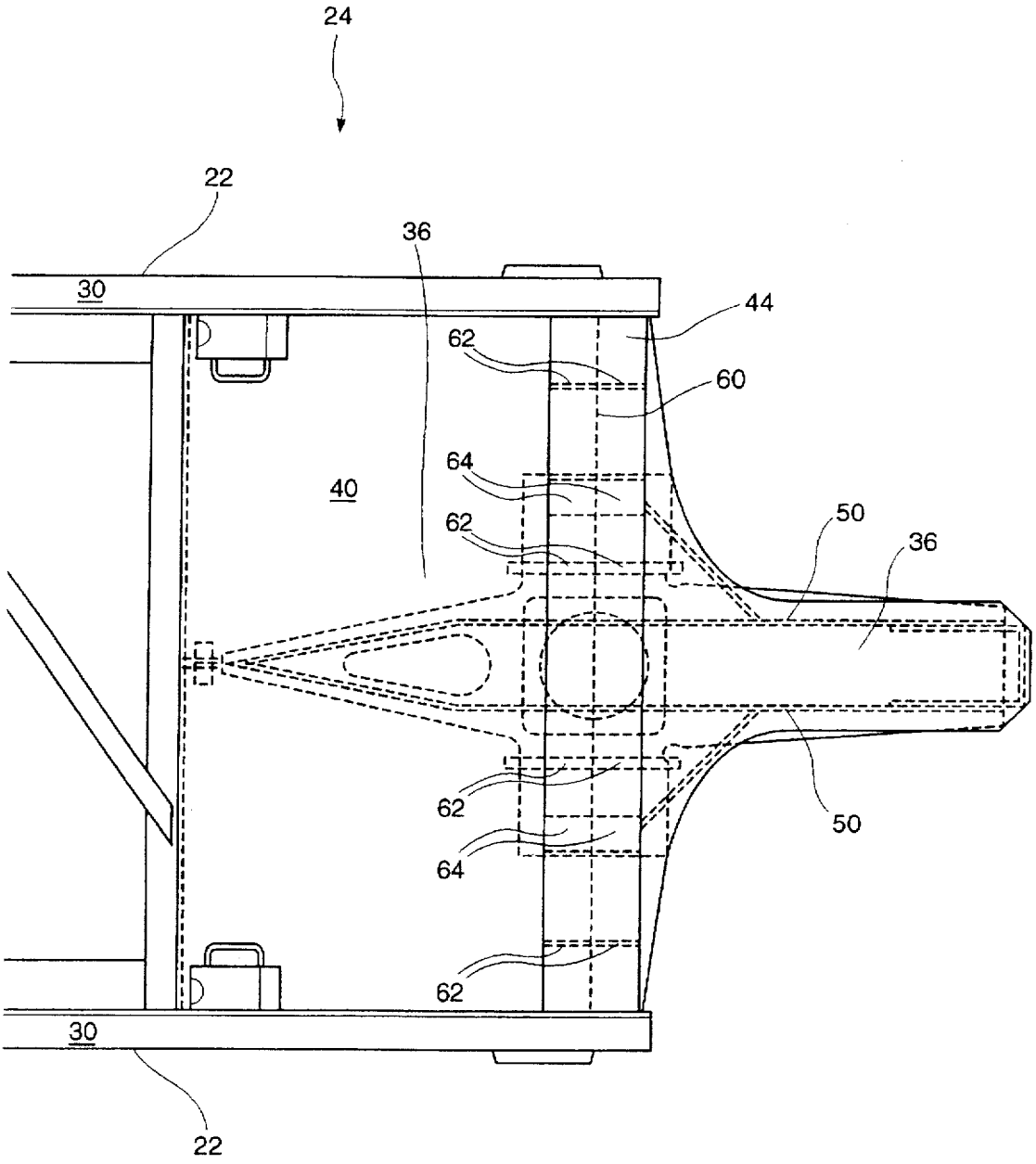
FIG. 5 is a top plan view of the end of the railroad car as depicted in FIG. 4.

As is best shown in FIGS. 4 and 5, the stub centre sill 36 runs beneath the longitudinal centre line of the car 20 and extends from an inboard position adjacent the bulkhead 42 to an outboard position external of the car body 20. A reader skilled in the art will readily appreciate that the stub centre sill 36 may be constructed in accordance with standard practice. The outboard end of the stub centre sill 36 houses a coupler means (Shown in FIG. 3) for coupling the car 20 to another car to form a train, such as a standard yoke and coupler assembly. In the preferred embodiment, the stub centre sill includes a generally horizontal top plate 46 (FIG. 4).

Figure 6:
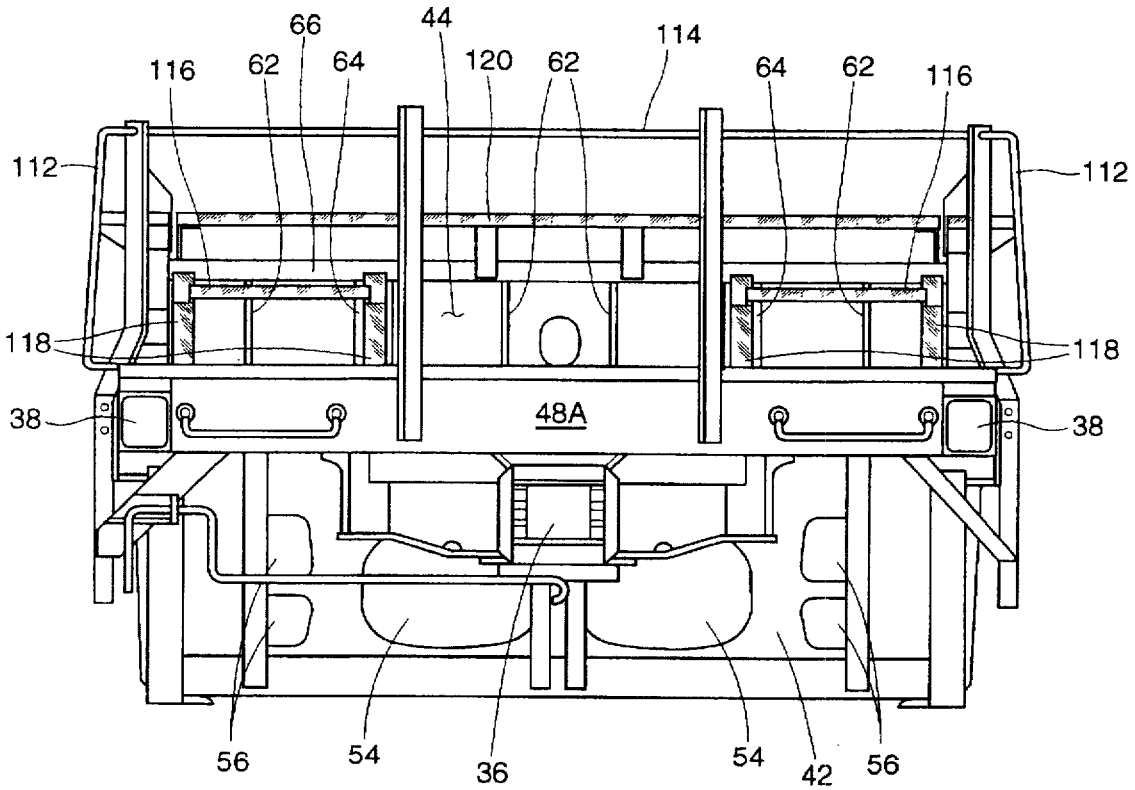
FIG. 6 is an end elevational view of the railroad car as depicted in FIG. 3.

A pair of longitudinally extending, spaced apart support arms 38 (one of which is shown in FIG. 3) are disposed in a flanking relationship relative to the stub centre sill 36, wherein the underside of each support arm 38 is substantially co-planar with the top plate 46 of the stub centre sill 36. Such support arms are attached at their inboard ends to the sidewalls 34 (FIG. 3). Two transversely extending, spaced apart members 48 are connected at their terminal ends to the support arms 38. The first transverse member 48A is connected to the outboard terminal ends of the support arms 38, and is shown in FIG. 6. The second transverse member 48B (not shown) is substantially parallel to, but inboard of the first transverse member 48A.

Figure 2:
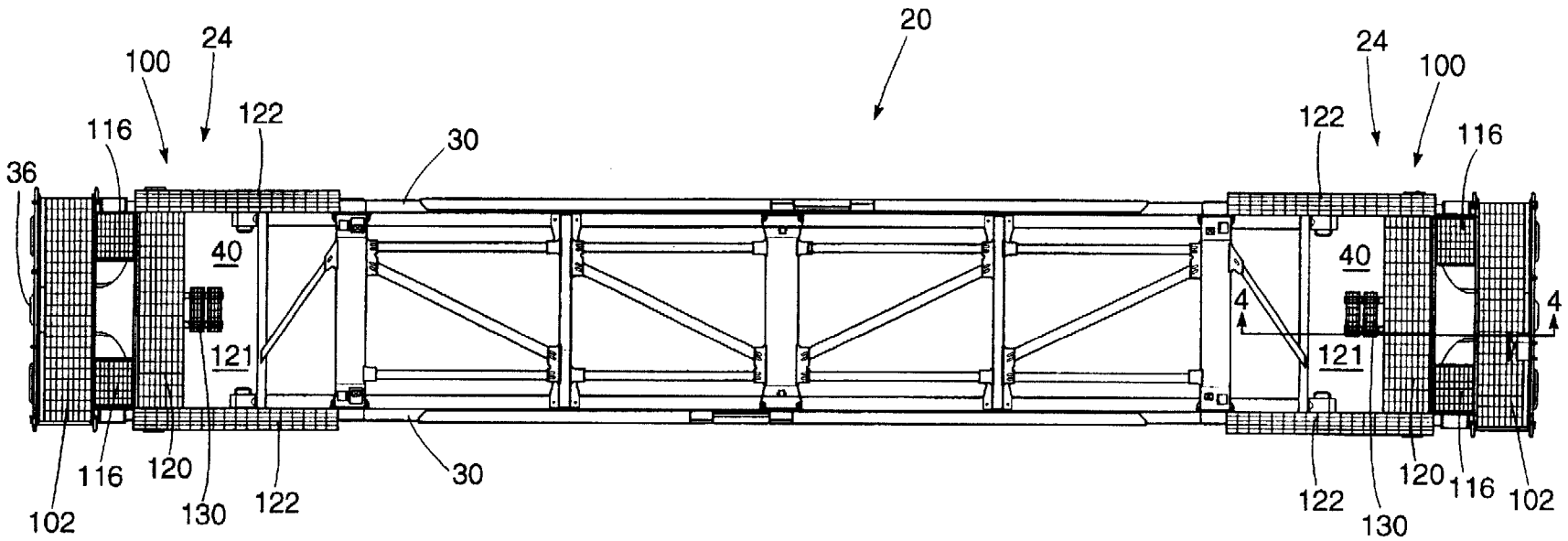
FIG. 2 is a top plan view of the railroad freight car as shown in FIG. 1.

As is best shown in FIGS. 2 and 4, the shear plate 40 is substantially planar and horizontally disposed. The shear plate 40 extends laterally between the side structures 22, to connect to the respective sidewalls 34 thereof. The shear plate 40 is positioned above the stub centre sill 36. The outboard peripheral edges of the shear plate 40 define overhanging extensions that project longitudinally beyond the outer edge of the upper bolster 44 and laterally beyond the stub centre sill side plates 50 (FIG. 4). As shown in FIG. 4, the shear plate 40 has an inboard terminal edge from which an upper terminal edge of the bulkhead 42 depends. Shear plate 40 is integral with the bulkhead 42 in the preferred embodiment. In the preferred embodiment, the bulkhead 42 is a continuation of the shear plate 40, wherein the inboard lateral edge of the shear plate 40 extends rearwardly and downwardly to merge with the upper portion 52 of the bulkhead 42.

Referring to FIG. 1, the bulkhead 42 extends laterally between sidewalls 34 and is joined thereto. Bulkhead 42 extends downwardly into the well portion from its upper portion 52 to a point just slightly below the top edge of the bottom side chord 32. The bulkhead 42 has two large access holes 54 (shown in FIG. 6) therein so that an operator can access the inboard areas of the truck 28 (not shown). In addition, the bulkhead 42 also has a plurality of footholds 56 therein to provide an operator with easier access into and out of the well of the car 20 (FIGS. 1 and 6). In the preferred embodiment, the footholds 56 are apertures in the bulkhead 42. In the preferred embodiment, bulkhead 42 is oriented at a slight angle away from the vertical (FIG. 4) to provide some additional clearance between the bulkhead 42 and the ends of containers located in the well portion of the car 20. Welded along the lower lateral edge of the bulkhead 42 is an angle member 58 (FIG. 4) which is connected at each end to a bottom side chord 32 of the car 20.

As shown in FIGS. 1, 5 and 6, the upper bolster 44 extends laterally for the width of the car 20. In the preferred embodiment, the upper bolster 44 comprises a single laterally extending vertical web 60, which is a plate, and a plurality of reinforcing members, as is best illustrated in FIG. 6. In the preferred embodiment, reinforcing members are vertical spaced apart plates 62 and vertical pressings 64 which are joined to both front and rear faces of the vertical web 60 such that the upper bolster 44 is symmetric about the vertical web 60. Vertical web 60 extends laterally between the sidewalls 34 of the car 20. The lower lateral edge of the vertical web 60 is joined to shear plate 40 (FIG. 4). The upper lateral edge of the vertical web 60 is joined to a top flange 66, which is joined at its ends to top side chords 30 (FIG. 4). The vertical edges of vertical web 60 are joined to the sidewalls 34 of car 20.

Each end structure has a particular platform arrangement 100 to facilitate access to the well of the car and to the longitudinal interface of containers in the upper and lower tiers of the double-stacked load. Referring to FIGS. 1 and 3, the platform arrangement comprises a transversely extending generally first horizontal platform surface 102 disposed at a position outboard of the upper bolster 44. The first horizontal platform surface 102 extends across the full width of the car 20. The outboard longitudinal edge of the first horizontal platform surface 102 is substantially in the same vertical plane as the outboard end of the stub center sill 36. The first horizontal platform surface 102 is supported by a plurality of longitudinally disposed brackets 104. The brackets 104 are mounted such that one end of the bracket is connected to the first transverse member 48A and the other end is connected to the second inboard transverse member 48B.

Referring to FIGS. 1, 3 and 6, a sill step 108 is mounted to the support arms 38 on each corner of the car adjacent the ends of a horizontal first platform surface 102 (FIG. 3). This sill step 108 provides a foot step at a height between the first horizontal platform surface 102 and the ground. Vertical hand rails 110 and 112 (FIG. 3) are also provided for an operator to grip while ascending or descending the sill step 108. A railing 114 (FIG. 6) is also provided at the outboard end of the first horizontal platform surface 102 providing an additional safety feature.

Referring now to FIGS. 1, 3 and 6, the platform arrangement 100 also comprises a second horizontal platform surface 120 which in the preferred embodiment has similar dimensions to the first platform surface 102 in the preferred embodiment and extends transversely for the full width of the car 20. The second horizontal platform surface 20 is disposed immediately above and is mounted on the top flange 66 of the upper bolster 44 (FIGS. 1 and 6).

The platform arrangement 100 also comprises an inboard intermediate horizontal platform surface 121 which is disposed below the second horizontal platform surface 120 and above the shear plate 40 at a position inboard of the upper bolster 44. In the preferred embodiment, the portion of the shear plate 40 inboard of the upper bolster 44 constitutes the intermediate horizontal platform surface 121.

The platform arrangement 100 also comprises an outboard intermediate generally horizontal platform surface 116. In the preferred embodiment, the outboard intermediate platform surface 116 is a pair of spaced, outboard intermediate generally horizontal platform surfaces 116 arranged in flanking relationship relative to the stub centre sill 36. The distance between the outboard lateral edges of the platforms 116 is approximately equal to the width of the well (FIG. 2). Each of the platforms 116 is disposed at a height intermediate of that of the first horizontal platform surface 102 and below the second horizontal platform surface 120 at a position outboard of the upper bolster 44, but inboard of the first horizontal platform surface 102. Each of the outboard intermediate horizontal platform surfaces 116 is disposed in a co-planar relationship with each other. Each of the outboard intermediate horizontal platform surfaces 116 is supported by a pair of brackets 118 secured at their upper, inboard ends to the top flange 66 of the upper bolster 44 and at their lower, outboard ends to the first horizontal platform surface 102 (FIG. 6). Alternatively, the outboard intermediate platform 116 is a single, generally horizontal platform surface 116 having its longitudinal centre line in the same general vertical plane as the longitudinal centre line of the stub centre sill 36.

The platform arrangement 100 further comprises a pair of longitudinal extending side platform surfaces 122. In the preferred embodiment, the second horizontal platform surface 120 is joined at each of its lateral ends to a side platform 122. Side platform surfaces 122 are located immediately above the side structures 22. The side platform surfaces 122 are mounted on top of top side chords 30 by means of angle member supports 124 (FIG. 3). The side platform surfaces 122 extend along an uppermost edge of each side structure 22 longitudinally from the outboard longitudinal end of top side chord 30 towards the centre of the car 20 a sufficient distance to permit an operator to walk thereon to the ends of short containers stacked in the well. The inner longitudinal edge of each side platform surface 122 is positioned slightly outward from the perimeter of the well so that it does not obstruct the loading and unloading of the containers to and from the well. The outer longitudinal edge of each side platform surface 122 extends transversely slightly beyond the side structures 22 to provide sufficient width for walking. Each side platform surface 122 is substantially co-planar with the second horizontal platform surface 120.

In order to facilitate an operator's descent from the second horizontal platform surface 120 onto the shear plate 40 of tile car 20, further, inboard intermediate horizontal platform surfaces, for example, steps 130, are provided from the second horizontal platform surface 120 to the shear plate 40. In the preferred embodiment, two steps are provided. However, a reader skilled in the art will readily appreciate that in other embodiments the number of steps may be varied.

Once an operator is at the shear plate 40 level, the operator may descend into the bottom of the well using the footholds 56 in the bulkhead 42. Handholds 140 adjacent the bulkhead 42 (FIG. 1) are also provided to assist an operator in maintaining his or her balance as he or she descends into or ascends from the well. The platform arrangement 100 constitutes means for accessing the well portion of the well car from ground level by successively stepping onto the first horizontal platform surface, the outboard intermediate horizontal platform surface, the second horizontal platform surface, the inboard intermediate platform surface, the shear plate and the footholds.

The foregoing detailed description has been given for clarity of understanding only and no unnecessary limitation should be understood therefrom, as various modifications of detail to the present invention will be apparent to those skilled in the art, all of which would come within its spirit and scope.

I claim:

1. A platform arrangement in an end structure of a railway well car, the railway well car having spaced apart side structures, opposing end structures and a floor structure extending between the side structures, whereby the side structures, end structures and floor structure together define a well portion for receiving a cargo container, the end structures each having spaced apart sidewalls, with a substantially planar and horizontally disposed shear plate extending between the sidewalls and connected thereto, the shear plate having an inboard end, each of the end structures further having a transverse structural member extending upwardly from the shear plate and between the sidewalls, the transverse structural member being connected to the shear plate and to the sidewalls, the end structure further having a bulkhead depending from the inboard end of the shear plate, the bulkhead extending into the well portion and between the sidewalls to connect thereto, and a stub centre sill for housing a coupler means for connecting the well car to another railway car, the stub centre sill being positioned below the shear plate and extending longitudinally of the well car from an inboard position adjacent the bulkhead to an outboard position external of the well car, the arrangement comprising:

(a) a first horizontal platform surface extending transversely of the well car and disposed at a position outboard of the transverse structural member;

(b) a second horizontal platform surface extending transversely of the well car and disposed immediately above the transverse structural member;

(c) an outboard intermediate horizontal platform surface disposed above the first horizontal platform surface and below the second horizontal platform surface at a position outboard of the transverse structural member;

(d) an inboard intermediate horizontal platform surface disposed below the second horizontal platform surface and above the shear plate at a position inboard of the transverse structural member; and (e) a foothold provided with the bulkhead and located at a vertical position intermediate of the shear plate and the floor structure;

wherein the platform arrangement constitutes means for accessing the well portion of the well car from ground level by successively stepping onto the first horizontal platform surface, the outboard intermediate horizontal platform surface, the second horizontal platform surface, the inboard intermediate platform surface, the shear plate and the foothold.

2. The platform arrangement according to claim 1, wherein the outboard intermediate horizontal platform surface is one of a plurality of platform surfaces disposed in a co-planar relationship with each other.

3. The arrangement according to claim 2, wherein the plurality of surfaces constitutes two surfaces arranged in a flanking relationship relative to the stub centre sill.

4. The arrangement according to claim 1, wherein the inboard intermediate horizontal platform surface is one of a plurality of surfaces each disposed below the second horizontal platform surface and above the shear plate.

5. The arrangement according to claim 4, wherein the said plurality of surfaces is a series of steps provided between the second horizontal platform surface and the shear plate.

6. The arrangement according to claim 5, wherein said series of steps comprises two steps.

7. The platform arrangement according to claim 1, wherein the transverse structural member is an upper bolster, and the second horizontal platform surface is mounted thereon.

8. The arrangement according to claim 1, wherein the first horizontal platform surface is disposed above the stub centre sill and is supported by a plurality of spaced apart and longitudinally extending support arms disposed in a flanking relationship relative to the stub centre sill, the support arms being attached at their inboard ends to the sidewalls of the end structure.

9. The arrangement according to claim 1, further comprising a pair of longitudinally extending side platform surfaces, each being respectively located immediately above the side structures of the end structure, each side platform surface extending along an uppermost edge of each said side structure, the side platform surfaces each having an inward longitudinal edge positioned outward from a perimeter of the well so as not to obstruct loading and unloading of a cargo container into and out of the well.

10. The arrangement according to claim 9, wherein the side platform surfaces are substantially co-planar with the second horizontal platform surface.

11. The arrangement according to claim 1, wherein a sill step is provided adjacent the first horizontal platform surface, to provide a foot step located at a vertical position intermediate to that of the first horizontal platform surface and ground level.

12. The arrangement according to claim 1, wherein the foothold is an aperture provided in the bulkhead.

13. The arrangement according to claim 11, wherein the foothold is one of a plurality of footholds provided with the bulkhead.

14. The arrangement according to claim 1, wherein the first horizontal platform surface and the second horizontal platform surface each extend transversely of the well car for substantially the full width thereof.

* * * * *